United States Patent [19]

Betenbaugh

[11] 4,257,392

[45] Mar. 24, 1981

[54] LOG SUPPORTING APPARATUS FOR USE WITH FIREPLACE GRATES

[76] Inventor: Walter R. Betenbaugh, 4024 Pomfret La., Charlotte, N.C. 28211

[21] Appl. No.: 30,145

[22] Filed: Apr. 16, 1979

[51] Int. Cl.[3] ..... F23H 13/00

[52] U.S. Cl. ..... 126/164; 126/336

[58] Field of Search ..... 126/298, 163, 152 B, 126/164, 126, 137, 154, 336, 152; D7/136; 248/214

[56] References Cited

U.S. PATENT DOCUMENTS

| | | | |
|---|---|---|---|
| 2,600,753 | 6/1952 | Gilbert | 126/298 |
| 4,019,493 | 4/1977 | McCullough | 126/165 |
| 4,069,808 | 1/1978 | Cranberg | 126/164 |
| 4,086,905 | 5/1978 | Dawson | 126/164 |

*Primary Examiner*—James C. Yeung

*Attorney, Agent, or Firm*—Bell, Seltzer, Park & Gibson

[57] ABSTRACT

A log supporting apparatus for use with a fireplace grate of the type having a plurality of laterally spaced bars defining a generally horizontally extending platform for supporting combustible logs thereon. The log supporting apparatus comprises L-shaped frame members each defined by a relatively short leg portion and a relatively long leg portion extending from and at a substantially right angle to the short leg portion. Brackets are adapted to be secured to rear portions of bars of the grate, and each frame member is removably secured to a bracket with the short leg portion of the frame member extending upwardly and rearwardly at an angle with respect to the platform and with the long leg portion extending upwardly and forwardly and overlying the platform so that logs may be supported upon the L-shaped frame members and may overlie logs supported on the platform.

2 Claims, 6 Drawing Figures

LOG SUPPORTING APPARATUS FOR USE WITH FIREPLACE GRATES

FIELD OF THE INVENTION

This invention relates to apparatus for aiding in the burning of combustible logs in fireplaces and is particularly concerned with an improved log supporting apparatus for use with fireplace grates.

BACKGROUND OF THE INVENTION

Various types of fireplace grates and attachments for use with fireplace grates have been proposed heretofore for aiding in the burning of combustible logs in a fireplace and to aid in directing radiant heat outwardly from the fireplace. In this regard, reference is made to Cranberg's U.S. Pat. No. 4,068,808, dated Jan. 24, 1978 wherein there are set forth typical problems which have been generally present earlier in the burning of combustible logs and wherein there is proposed a solution to the problem of inefficient radiation of heat from a fireplace by supporting the combustible logs in a generally C-shaped configuration such as to approximate an enclosure having a small opening facing in the direction in which thermal radiation energy is desired. In practice, it has been determined that the burning of logs in such a C-shaped configuration will result in effectively directing the thermal energy outwardly from the front opening of a fireplace into an adjacent room area.

Therefore, it is an object of this invention to provide an improved log supporting apparatus for use with a fireplace grate for supporting combustible logs in a generally C-shaped configuration.

SUMMARY OF THE INVENTION

According to the invention, a log supporting apparatus is provided which is adapted for use with a wide variety of fireplace grates of the type having a plurality of laterally spaced bars defining a generally horizontally extending platform and being provided with rear portions thereon.

The log supporting apparatus of the present invention comprises one or more substantially L-shaped frame members each defined by a relatively short leg portion and a relatively long leg portion extending from and at a substantially right angle to the short leg portion. Bracket means is adapted to be removably secured to rear end portions of corresponding bars of the grate, and means is provided for removably securing each frame member to a respective one of the bracket means with the short leg portion thereof extending upwardly and rearwardly at an acute angle with respect to the generally horizontally extending platform and with the respective long leg of each frame member extending upwardly and forwardly and overlying the platform so that combustible logs may be supported on the generally horizontally extending platform and other combustible logs may be supported upon the substantially L-shaped frame members so that they may overlie the first-mentioned combustible logs thereon and, collectively, the logs are supported in a generally C-shaped configuration in the fireplace.

BRIEF DESCRIPTION OF THE DRAWINGS

Some of the objects and advantages of the invention having been stated, others will appear as the description proceeds when taken in connection with the accompanying drawings, in which.

DETAILED DESCRIPTION

Figures 1, 2, 3, 4, 5, 6:
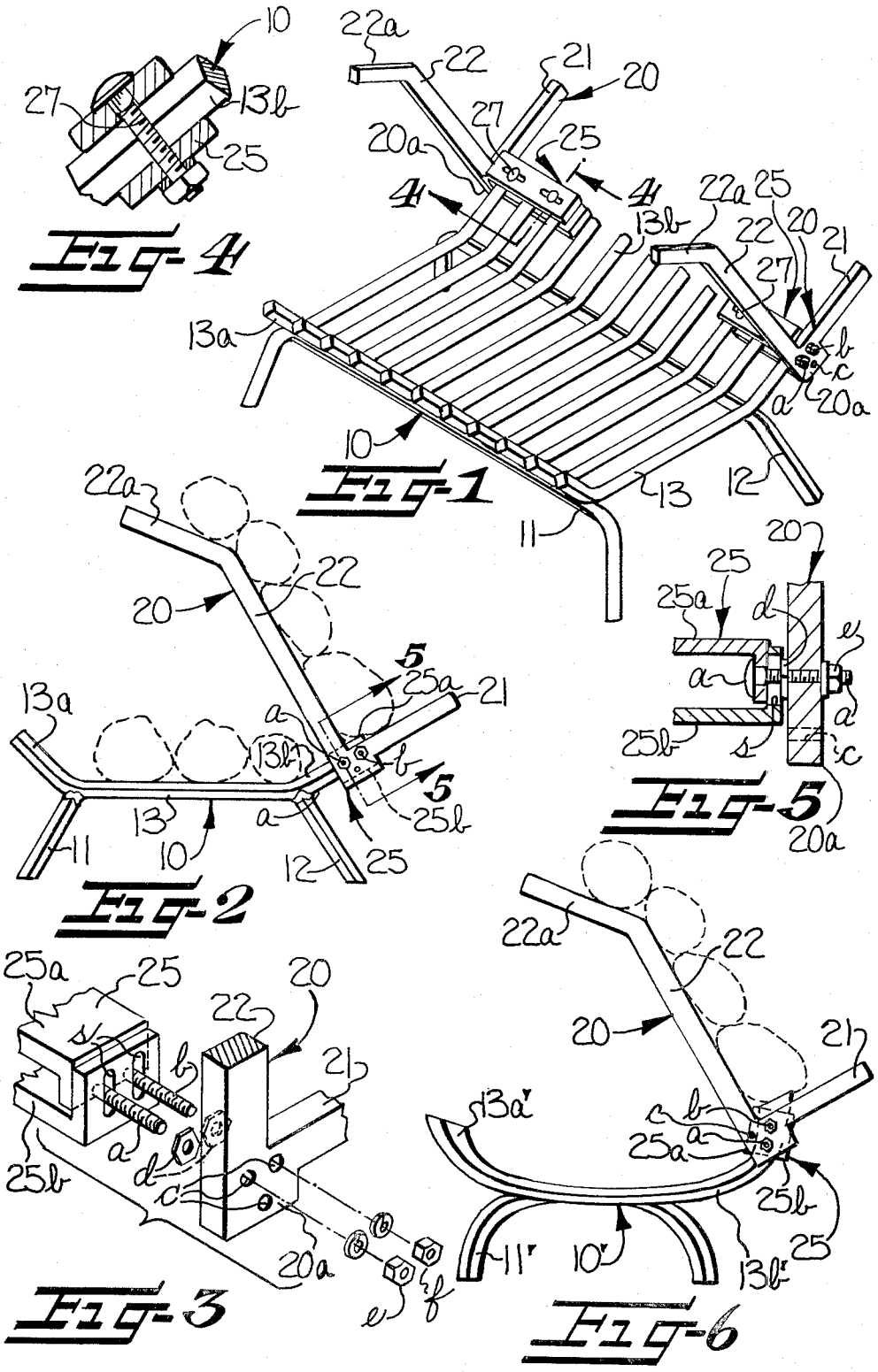
FIG. 1 is a perspective view of a typical fireplace grate showing a preferred embodiment of the improved log supporting apparatus of the present invention mounted thereon.
FIG. 2 is a side elevation of the apparatus looking at the right-hand side of FIG. 1.
FIG. 3 is an enlarged partially exploded perspective view illustrating a preferred manner of connecting the L-shaped frame members of the present invention to the bracket means.
FIG. 4 is an enlarged fragmentary detail, partially in section, taken substantially along line 4—4 in FIG. 1.
FIG. 5 is an enlarged fragmentary sectional view taken substantially along line 5—5 in FIG. 2.
FIG. 6 is a view similar to FIG. 2, but illustrating one of the L-shaped log supporting frame members in association with a somewhat different form of fireplace grate than that shown in FIG. 1.

Referring more specifically to the drawings, with particular reference to FIGS. 1 and 2, the numeral 10 broadly designates a typical fireplace grate with which the improved log supporting apparatus is adapted to be used. As shown, the grate 10 may comprise front and rear standards 11, 12 on which are welded or otherwise suitably secured a plurality of generally parallel, laterally spaced grate bars or ribs 13 defining a generally horizontally extending platform for supporting combustible logs thereon.

As is well known in the art, the ribs or bars of various grates may take various forms; e.g., they may be curved along their lengths and/or their end portions, or they may be straight throughout their lengths. By way of illustration only, the grate bars 13 of FIGS. 1 and 2 are shown as being substantially straight along their major portions with their front and rear end portions 13*a*, 13*b* extending upwardly at a shallow or acute angle with respect to the generally horizontally extending platform defined by the grate bars 13.

A grate 10' of generally similar construction to that of the grate 10 of FIGS. 1 and 2 is shown in FIG. 6 with those parts of the grate 10' which correspond to generally similar parts of the grate 10 bearing the same reference characters with the prime notation added in order to avoid repetitive description.

In this instance, it will be noted that the grate bars or ribs 13' on the standards 11', 12' of the grate 10' in FIG. 6 are curved slightly along their lengths with their upturned front and rear end portions 13*a'*, 13*b'* being thicker than the intermediate or medial portions of the bars 13' and also extending upwardly at a substantially steeper angle or more upright than those front and rear end portions 13*a*, 13*b* of the grate bars 13 of FIGS. 1 and 2. The two forms of grate 10, 10' are illustrated to show how the improved log supporting apparatus of the present invention may be readily adapted for use with different forms of grates, as will be presently described. Although only two forms of grates are illustrated in the present drawings, it will be apparent as the description proceeds that the grate may be of other forms without departing from the invention.

The log supporting apparatus of the present invention is auxiliary to the log supporting grate 10 in FIGS. 1 and 2 or 10' in FIG. 6, and in its preferred embodiment, the log supporting apparatus of the present invention preferably comprises a pair of substantially L-shaped log supporting frame members 20 each defined by a relatively short leg portion 21 and a relatively long leg portion 22 extending from and at a substantially right angle to the short leg portion 21. Means are provided for removably securing each L-shaped frame member 20 to a respective bracket means 25 which is, in turn, adapted to be removably secured to the rear end portions 13*b* of bars 13 of grate 10 as shown in FIGS. 1–4. Accordingly, each bracket means 25 may take the form of a cooperating pair of substantially L-shaped clamping members or brackets 25*a*, 25*b* (FIGS. 3 and 5) defining therebetween a slot through the respective bracket means 25. The brackets 25*a*, 25*b* are adapted to receive in the slot therebetween rear end portions 13*b* of two or more of the bars 13 adjacent a corresponding end of the grate 10. Bolt means 27 (FIGS. 1 and 4) extends through the clamping members of each bracket means 25 and is adapted to extend between adjacent grate bar rear end portions 13*b* of grate 10 for securing the bracket means 25 to the grate. As preferred, the bolt means 27 may be tightened sufficiently to clampingly secure the bracket means 25 to the grate bars 13.

The means for removably securing each substantially L-shaped frame member 20 to the respective bracket means 25 is arranged so that the short leg portion 21 of each frame member 20 extends upwardly and rearwardly at an acute angle with respect to the generally horizontally extending platform of the grate 10 and so that the respective long leg portion 22 of each frame member 20 extends upwardly and forwardly at an angle and overlies the generally horizontal grate platform for thus supporting combustible logs upon the long leg portions 22 in overlying relation to but spaced above those logs resting upon the bars 13 of the grate 10. The logs are shown in broken or phantom lines in FIG. 2.

The L-shaped log supporting frame members 20 are also mounted for forward and rearward adjustment adjacent the juncture of the leg portions 21, 22 on the respective bracket means 25 for accommodating various sizes of combustible logs on the grate 10 and for establishing the desired position of a layer of logs on the L-shaped frame members 20 for obtaining a generally C-shaped or wedge-shaped configuration of the logs carried by the grate and the frame members 20 to obtain an efficient radiation of heat energy outwardly from the fireplace.

Accordingly, the means for removably securing each L-shaped frame member 20 to the respective bracket means 25 may take the form of bolt means, a pair of threaded rods, or a pair of threaded studs a, b carried by and extending laterally outwardly from the outer end of the respective bracket means 25. In this instance, the threaded studs a, b are shown in FIG. 5 in the form of carriage bolts or step bolts whose square or polygonal step or shoulder portions loosely fit in correspondingly shaped holes in the shorter end arm of the L-shaped clamping member 25*a* so as to prevent such bolts from turning relative to the clamping member 25*a*. The carriage bolts or studs a, b loosely penetrate adjustment slots s in the shorter of the two arms of the L-shaped clamping member 25*b*, permitting adjustment of the clamping members 25*a*, 25*b* toward and away from each other to suit the thickness of the grate bar end portions 13*b* of the grate 10, for example.

Each L-shaped frame member 20 is provided with an outwardly projecting mounting portion 20*a* integral with and projecting outwardly away from the juncture of the respective pair of leg portions 21, 22. The mounting portion 20*a* of each L-shaped frame member 20 has a plurality of stud receiving bores or holes c therethrough (there being three such holes c shown in FIG. 3) for slideably receiving corresponding studs a, b therein, depending upon the desired adjusted position of each L-shaped frame member 20. In other words, the studs a, b may penetrate any two of the holes c, and as shown in FIGS. 1 and 2, the studs a, b are penetrating the tow holes c closest to the leg 22 of the frame member 20 there shown.

With the mounting portion 20*a* of an L-shaped frame member 20 positioned against the outer end of the respective bracket means 25 and the studs a, b extending through any desired two of the bores c, the L-shaped frame member 20 is removably secured to the respective bracket 25 by tightening threaded nuts e, f onto the threaded outer ends of the studs a, b and against the outer surface of the mounting portion 20*a* of the respective L-shaped frame member 20 to secure the same in the desired adjusted position with respect to the grate 10.

Since the forward ends of the long leg portions 22 of the L-shaped log supporting frame members 20 may occupy substantially more elevated or higher positions in a fireplace than that occupied by the platform of a conventional grate, such as the grates 10, 10' of FIGS. 1, 2 and 5, it is preferred that the forward end of each leg portion 22 has a log lead-in extension or front end portion 22*a* thereon which extends forwardly at an obtuse angle with respect to the upper surface of the corresponding leg portion 22 to thereby aid in guiding logs onto the long leg portions 22 of the L-shaped log supporting frame members 20 as the logs are being placed manually thereon. It is apparent that the relatively short leg portions 21 of the L-shaped frame members are provided for restraining logs deposited on the longer leg portions 22 from rearward gravitational movement off of the longer leg portions.

From the foregoing description, it can be appreciated that the bracket means 25 for supporting the L-shaped log supporting frame members 20 may be readily positioned on the upturned rear end portions 13*b* of the grate bars 13 in FIGS. 1 and 2, or alternatively, they may be readily positioned on the upturned rear end portions 13*b'* of the grate bars 13' even though those upturned rear end portions 13*b* of the grate bars 13' in FIG. 6 are of somewhat larger cross-sectional area and are of somewhat different shape than the upturned rear end portions 13*b* in FIGS. 1 and 2. However, since the upturned rear end portions 13*b'* of the grate 10' in FIG. 6 occupy a more vertical or upright position than is the case with respect to the upturned rear end portions 13*b* of the grate bars 13 in FIGS. 1 and 2, it follows that the bracket means 25 occupies a more tilted or angular position in FIG. 6 than it does in FIGS. 1 and 2. Accordingly, it can be seen in FIG. 6 that the studs a, b penetrate different respective ones of the holes c of FIG. 3 than they do in FIGS. 1 and 2 so that the log supporting frame member may occupy a desired angular position relative to the grate 10'. In other respects, the structure shown in FIG. 6 is essentially the same as the embodiment of FIGS. 1–5, and therefore, a more detailed description of the embodiment in FIG. 6 is deemed unnecessary.

It is contemplated that, if desired, the two holes c farthest from the leg portion 22 (occupying the position of the two studs a, b in FIG. 6) alternatively may be in the collective form of an arcuate slot (not shown) interconnecting those two holes to permit further latitude in angular adjustment of each respective L-shaped log supporting frame member 20. Such arcuate slot may be generated about the axis of the other of the holes c then remaining in the log supporting frame member 20 so the frame member 20 may be pivotally adjusted about the latter axis.

In the event that it is desirable to hold the two clamping members 25*a*, 25*b* of a bracket means 25 in a predetermined adjusted spaced relationship while they are removed from a grate, they may be held in such a preadjusted relationship by means of a pair of relatively thin lock nuts d (FIG. 3) which may be tightened on the threaded studs a, b and against the shorter arm of the clamping member 25*b* prior to mounting the respective log supporting frame member 20 on the respective pair of studs a, b.

From the foregoing description, it can be seen that there is provided a log supporting apparatus adapted for use with a fireplace grate 10 or 10' of a type having a series or plurality of generally parallel, laterally spaced grate bars 13 or 13' defining a generally horizontally extending platform, and wherein the log supporting apparatus comprises a pair of substantially L-shaped frame members 20 each defined by a relatively short leg portion 21 and a relatively long leg portion 22 extending from and at an angle to the respective short leg portion 21, and wherein bracket means 25 is adapted to be removably secured to rear end portions of bars 13 or 13' adjacent each end of the grate, and means are provided for removably securing each frame member 20 to a respective one of the bracket means 25 with the short leg portion 21 thereof extending upwardly and rearwardly at an angle with respect to the generally horizontally extending grate platform and so that the respective long leg portion 22 of each frame member extends forwardly and upwardly at an angle and overlies the platform for supporting logs on the grate and on the L-shaped frame members in a generally C-shaped cross-sectional configuration to aid in producing controlled and efficient combustion of the logs and whereby thermal energy from combustion may be effectively directed forwardly from the fireplace.

In the drawings and specification there have been set forth preferred embodiments of the invention and, although specific terms are employed, they are used in a generic and descriptive sense only and not for purposes of limitation.

That which is claimed is:

1. A log supporting apparatus adapted for use with a fireplace grate of a type having a plurality of laterally spaced bars having rear portions thereon and defining a generally horizontally extending platform for supporting combustible logs thereon, said log supporting apparatus comprising a relatively short leg portion and a relatively long leg portion extending from and at a substantially right angle to said short leg portion and defining therewith a substantially L-shaped frame member, bracket means adapted to be removably secured to rear end portions of the bars of the grate, said bracket means having a slot therein adapted to receive therein the rear end portions of the grate bars, bolt means extending through said bracket means and adapted to extend between adjacent bar rear end portions of the grate for securing said bracket means to the grate, and means for removably securing said L-shaped frame member to said bracket means with the short leg portion thereof extending upwardly and rearwardly at an acute angle with respect to the generally horizontally extending platform and with said long leg portion of said frame member extending upwardly and forwardly and overlying the platform for supporting other combustible logs thereon, said means for removably securing said L-shaped frame member to said bracket means comprising means for connecting said L-shaped frame member to one side of said bracket means for rearward and forward adjustment thereon relative to the platform and including threaded means for securing said L-shaped frame member in a desired adjusted position relative to said bracket means.

2. A log supporting apparatus adapted for use with a fireplace grate of a type having a plurality of laterally spaced bars having rear portions thereon and defining a generally horizontally extending platform for supporting combustible logs thereon, said log supporting apparatus comprising a relatively short leg portion and a relatively long leg portion extending from and at a substantially right angle to said short leg portion and defining therewith a substantially L-shaped frame member, bracket means adapted to be removably secured to rear end portions of the bars of the grate, said bracket means comprising a pair of cooperating brackets defining therebetween a slot adapted to receive therein the rear end portions of the grate bars, and bolt means extending through said bracket means and adapted to extend between adjacent bar rear end portions of the grate for securing said bracket means to the grate, and means for removably securing said L-shaped frame member to said bracket means with the short leg portion thereof extending upwardly and rearwardly at an acute angle with respect to the generally horizontally extending platform and with said long leg portion of said frame member extending upwardly and forwardly and overlying the platform for supporting other combustible logs thereon, said L-shaped frame member having a plurality of holes therethrough adjacent the juncture of said short and long leg portions thereof, and said means for removably securing said L-shaped frame member to said bracket means comprising bolts carried by at least one of said cooperating brackets and extending through at least selected ones of said holes in said L-shaped frame member for securing said L-shaped frame member to said bracket means.

* * * * *